United States Patent [19]

Copeland

[11] Patent Number: 5,001,786

[45] Date of Patent: Mar. 26, 1991

[54] HELMET INFORMATION DISPLAY

[76] Inventor: Bruce J. Copeland, 3165 Mt. Acmar Ct., San Diego, Calif. 92111

[21] Appl. No.: 306,585

[22] Filed: Feb. 6, 1989

[51] Int. Cl.[5] ..... A42B 3/02; A42B 1/24

[52] U.S. Cl. ..... 2/424; 2/410; 350/174

[58] Field of Search ..... 2/2.1, 6, 422, 424, 2/410; 350/174

[56] References Cited

U.S. PATENT DOCUMENTS

| | | | |
|---|---|---|---|
| 3,923,370 | 12/1975 | Mostrom | 350/174 X |
| 4,081,209 | 3/1978 | Heller et al. | 350/174 |
| 4,153,952 | 5/1979 | Dussich | 2/6 X |
| 4,633,532 | 1/1987 | Yagasaki | 2/424 |
| 4,719,462 | 1/1988 | Hawkins | 2/6 X |
| 4,761,056 | 8/1988 | Evans et al. | 350/174 |

FOREIGN PATENT DOCUMENTS

| | | | |
|---|---|---|---|
| 88/02494 | 4/1988 | PCT Int'l Appl. | 350/174 |
| 2197448 | 5/1988 | United Kingdom | 2/422 |

*Primary Examiner*—Wm. Carter Reynolds
*Attorney, Agent, or Firm*—Henri J. A. Charmasson

[57] ABSTRACT

A visual information display is added to a prior art motorcycle helmet having a headlight. A portion of the light from the headlight is diverted to illuminate an information indicator within the interior portion of the helmet. The information indicator is a translucent disk, rotated in response to a sensor signal, such as a heading indicator. Colored direction indicating symbols are projected onto the visor in an area not interfering with the motorcyclist's vision. A detachable cable connected to the motorcycle battery provides power to operate the headlight.

4 Claims, 2 Drawing Sheets

HELMET INFORMATION DISPLAY

FIELD OF THE INVENTION

This invention relates to helmets and information displays. More specifically, the invention relates to lighted helmets and lighted information displays.

BACKGROUND OF THE INVENTION

The primary objectives of a lighted helmet are to: adequately illuminate a field of interest to the operator; and not interfere with the helmet's protective functions. It should also be light weight, rugged in construction, pleasing in appearance, easy to turn on and off, and low in cost. When the helmet is not in use, a minimum of effort to remove and install the helmet is also desirable.

The primary objectives of an information display are to: provide needed information to an operator; and not interfere with operator vision or other operator functions. It should also be small, light weight, rugged in construction, pleasing in appearance, and low in cost. The ability to easily remove unnecessary displays is also desirable.

Most of the current lighted helmets and information displays may do some of these objectives well, but others poorly or not at all. Current battery operated lighted helmets are limited in candlepower or endurance because of battery weight limitations. Sufficiently large batteries would place an unacceptably high load on the operator head. When more light or endurance is required, separate portable battery packs or sources of power require connectors and cables. U.S. Pat. Nos. 4,530,112 and 4,638,410 illustrate this type of lighted helmet.

The use of helmet mounted lights for operators of motorcycles provides major advantages, especially for highly maneuverable recreational applications. During maneuvers, the field of interest is not necessarily in front of the motorcycle (where fixed mounted lights illuminate), or in the rotational plane of the front wheel (where front fork mounted lights illuminate). The field of operator interest is where the operator wants to go (or avoid going). A helmet mounted light allows the operator to illuminate this field by a turn or lift of his or her head.

Current vehicle related information displays are typically attached to the vehicle. Some of the displays are lighted, if needed for night operation. Vehicle speed, direction, and other information must be derived by glancing to the displays and away from (down) the field of interest.

More sophisticated information displays, such as used for military applications, are attached to a helmet. A visor or other helmet surface provides a surface for displaying targeting or other information. This type of information display requires additional power, power and sensor cables, and connectors. The cost and complexity of the helmet mounted display has resulted in limited current applications, except for the military.

If a lighted helmet is used by a vehicle operator, such as on a motorcyclist, glancing can also remove the light from the field of interest. This can result in a dangerous situation for night-time vehicle operation. As a result, along with other facts, most motorcycle-type lights are mounted to the vehicle, as illustrated by U.S. Pat. No. 4,625,264. If helmet mounted lights are used, they may be used with the vehicle mounted lights to avoid these glancing to information display problems.

These prior vehicle mounted displays, vehicle lights and multi-light approaches have many limitations. These are primarily related to the multiplicity of elements (e.g., lights for the displays, lights on the vehicle and lights on the helmet) required to accomplish the operating objectives. This multiplicity creates added cost, weight and space. This multiplicity of elements, weight and space also particularly detract from the safety of the operator. The required glancing away from the road or critical area of interest in order to read the information display distracts the operator.

What is needed is a display means which does not require the light helmet wearer to glance away from the illuminated field of interest. What is also needed is to reduce the complexity and multiplicity of information display components.

SUMMARY OF THE INVENTION

The principal and secondary objects of the invention are:

- To provide a powerful helmet mounted means for illumination;
- To provide an information display which does not require a separate illumination at night; and
- To provide an information display that does not require glancing away from the illuminated field of interest.

These and other objects are achieved by a pair of helmet mounted lights illuminating an area of interest ahead of the operator. A portion of the light is diverted to project an information display within the interior portion of the helmet. The information display is a translucent disk, rotated in response to information, such as direction. Colored symbols indicating direction are projected onto the visor in an area not interfering with motorcycle operation. A detachable cable connected to the motorcycle battery supplies the power to operate the pair of lights.

DESCRIPTION OF THE PREFERRED EMBODIMENT

Figure 1:
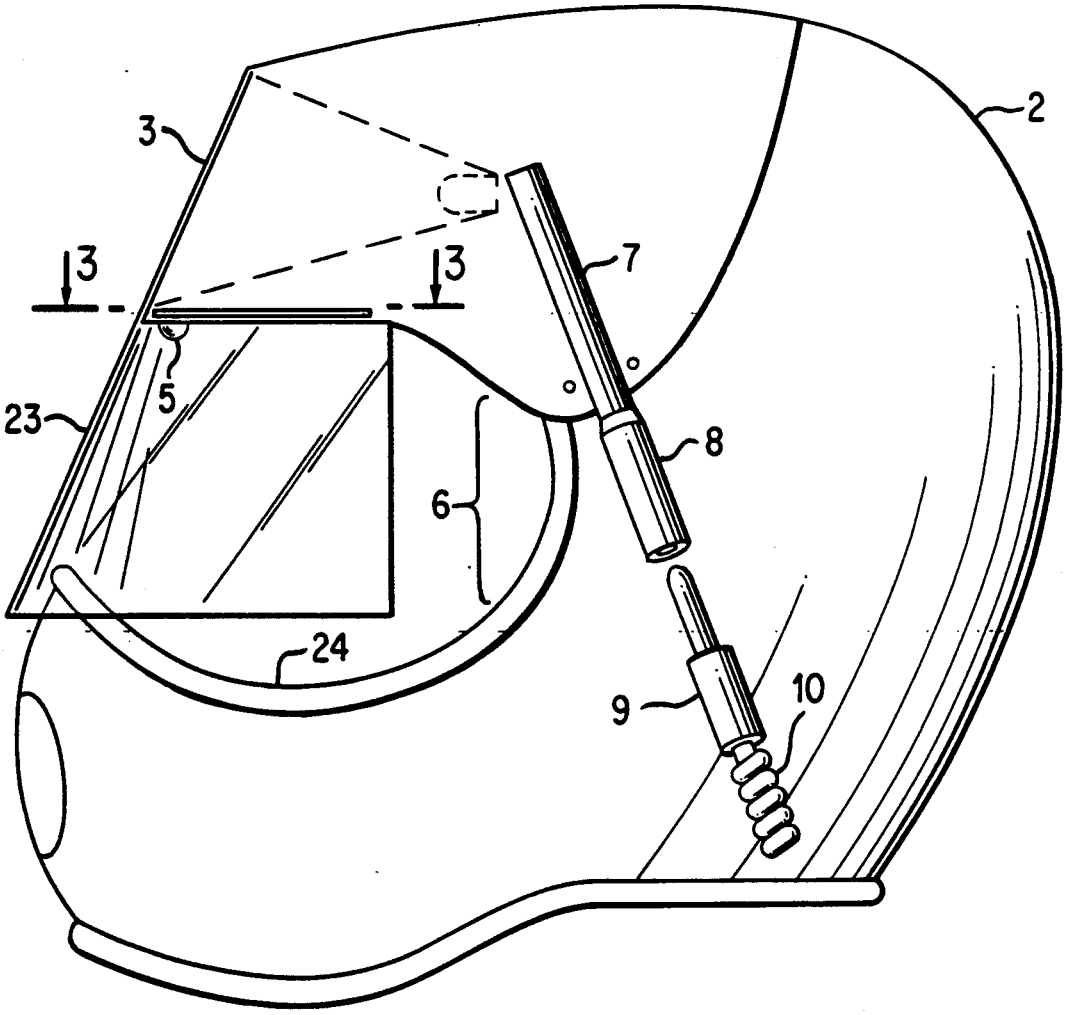
FIG. 1 shows a side view of a lighted helmet and display.

FIG. 1 shows a side view of the preferred embodiment of a lighted helmet and display. The helmet 2 is placed over the motorcycle operator's head. An attachment 2A is placed above the front visual opening (i.e., opening 6 allowing the operator to see an area of interest) and is attached by frangible fasteners 2B to helmet 2. In an alternate configuration, attachment 2A may be integral with helmet 2. Attachment 2A contains at least two translucent portions. A first transparent lens or panel 3 allows interior lamps or source of light 4 (shown dotted for clarity) to project light directly ahead of the operator's head. A second small translucent or transparent lens or button 5 allows light from one of the lamps 4 to illuminate or be illuminated within the operator's field of vision, within the opening 6.

An electric cable 7 provides a means to supply electric power to the lamp 4. The insulated conductors within the cable 7 terminate at a female connector 8. A mating male connector 9 (shown exploded for clarity) is attached to a coiled electrical cable 10, which connects to the motorcycle battery (not shown for clarity).

Figure 2:
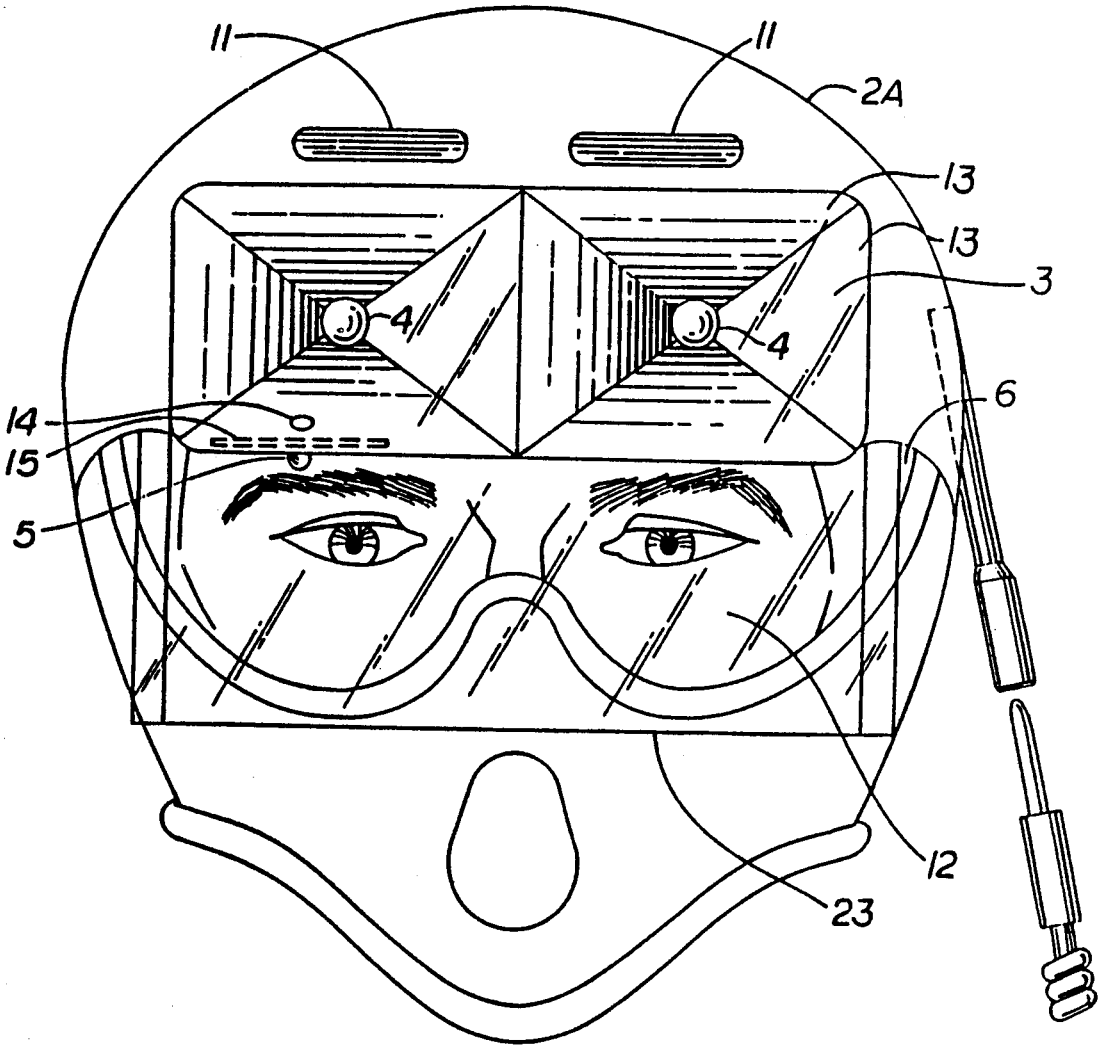
FIG. 2 shows a front view of the lighted helmet and display.

FIG. 2 shows a front view of the lighted helmet and display. The attachment 2A or helmet 2 has several vents 11 to provide cooling for lamps 4. Through the clear first transparent panel 3, a pair of lamps 4 project light forward. Reflecting surfaces 13 are also visible through the transparent panel 3. The reflecting surfaces 13 are shown as intersecting panels, but may be paraboloid or other shaped surface to reflect light forward from the lamps 4. A hole 14 in one of the reflector surfaces 13 allows some of the light from the lamp 4 to project through the second transparent button 5 to within the helmet opening 6. Some of this light may also be visible on visor 23. The lamps 4 through a color coded translucent disk 15 illuminates button or information indicator 5.

Figure 3:
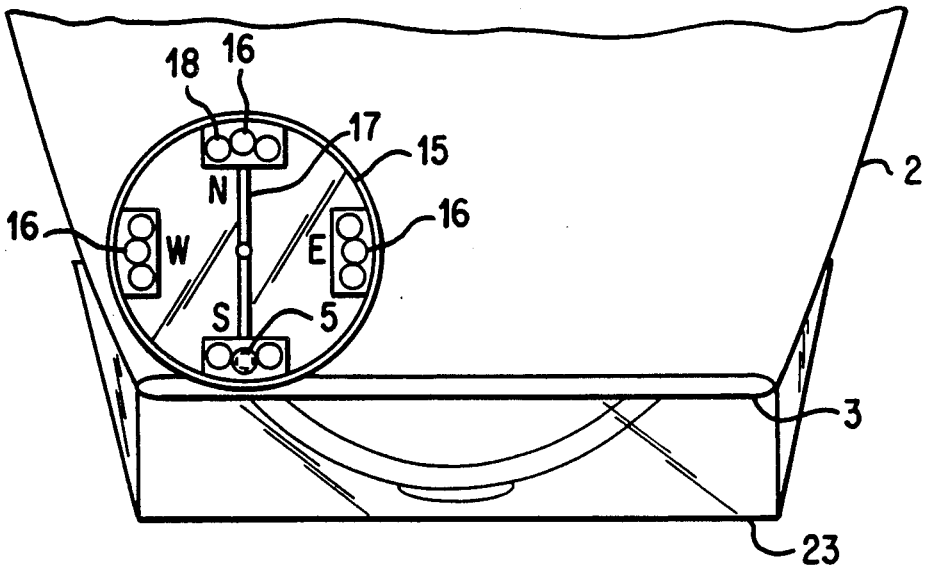
FIG. 3 shows a top cross sectional view of the lighted helmet and display.

FIG. 3 shows a top cross sectional view 3—3 of the lighted helmet and display shown in FIG. 1. Helmet 2 or attachment 2A contains a rotatable disk 15. Disk 15 has a series of color coded translucent circles or lenses 16 mounted into apertures therethrough which can be rotated over button 5 (shown dotted for clarity). Rotation of the disk 15 is controlled by a permanent magnet or coiled electro-magnet 17 acting as a magnetic compass. As the direction of travel changes, a different color circle 16 is projected upon the button 5. Colors in the preferred embodiment are blue for the N direction representing north, green for south (S), yellow for east (E), and red for west (W). Combined color shades represent intermediate positions, such as various shades of purple (blue and red combinations) for northwest 18 directions. The specific northwest direction shown at 18 would be predominantly blue, having a small amount of red to show a northwestern direction close to north. The colored circles may be replaced by a continuous color strip, having continuously changing colors indicating changing directions. Illumination may be provided by ambient exterior light penetrating through the first transparent panel 3 or the lamps 4 (see FIG. 2). Colored circles may also be visible on visor 23.

Figure 4:
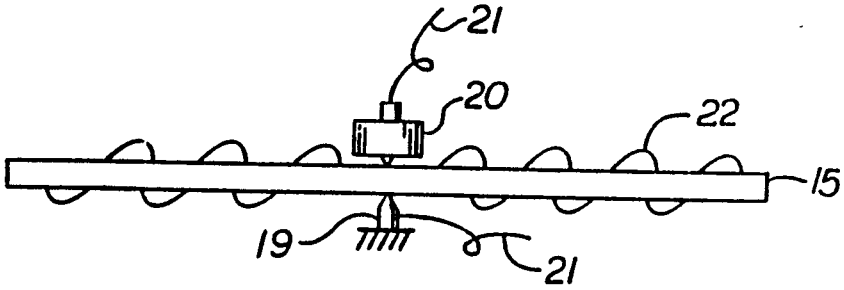
FIG. 4 shows a side view of the translucent display disk.

FIG. 4 shows a side view of the translucent display disk. A needle bearing 19 supports the rotatable disk 15. A corresponding spring loaded or biased needle bearing 20 retains the disk 15 between the two bearings 19 and 20. In the configuration shown, electric conductors 21 allow signals or electric current to be transmitted to the disk 15. Electric current through the coils 22 generates an electromagnetic field. The electromagnetic field interacts with the magnetic field of the earth, tending to rotate the disk until the electromagnetic field points to the earth's magnetic north pole.

Alternative embodiments of the invention can be provided signal inputs from the motorcycle through cables 21 rather than a current to actuate an electromagnetic. Signals, such as vehicle speed, would actuate the disk (actuator could be housed within bias housing 20). The disk would rotate to specific positions upon input of specific speed related signals. The second color coded disk button 5 would indicate vehicle speed, for example, green for speed below a speed limit, and red for speeds above the limit.

Another embodiment could directly project colors or symbols on a visor 23 (see FIG. 1) or interior portion 24 of the helmet showing position, direction, speed or other information desired by the operator. Projected image, such as letters or numbers, could be placed at non interfering locations by a prism located in place of the button 5. The prism could act both as an indicator and a selectable projection device. Projection on the visor of faint colors or images would not change the primary transparent quality of the visor. The faint transparent projected colors or images would still transmit information to the operator.

These alternative embodiments still use the lamps 4 (see FIG. 2) as a means for illuminating for both the field of interest in front of the operator and the information display. A turn or lifting of the operator's head illuminates a new portion of the road or other new field of interest.

Still other embodiments could provide shock mounting and damping of acceleration motions imparted to the indicator disk 15 supplanting or assisting the needle bearings 19 and 20 (see FIG. 4). The disk may also have shapes other than a circle and be actuated in ways other than rotation.

While the preferred embodiment of the invention has been shown and described, and some alternative embodiments also shown and described, changes and modifications may be made therein within the scope of the appended claims without departing from the spirit and scope of this invention.

What is claimed is:

1. In combination with a motorcyclist's helmet or the like including a transparent visor extending in a generally downward direction, said visor having an inner surface facing the helmet wearer's eyes, an information display device which comprises:

a headlight mounted in the upper section of the helmet, said headlight being oriented to illuminate an area in front of said wearer;

means for diverting a portion of light emitted by said headlight and for projecting said portion against said inner surface;

a movable indicator mounted across said portion of light between said means for diverting and projecting and said inner surface; and means for moving said indicator.

2. The combination of claim 1, wherein said indicator is a disk having translucent lenses of different colors mounted into apertures in said disk.

3. The combination of claim 2, wherein said means for moving comprises a magnetic compass coupled to said disk.

4. The combination of claim 3, wherein said lenses are color-coded and positioned on said disk to change a portion of the light projected against said inner surface in response to orientation of the helmet.

* * * * *